US008091263B1

(12) United States Patent
Palmer

(10) Patent No.: US 8,091,263 B1
(45) Date of Patent: Jan. 10, 2012

(54) REDUCED RECOIL CHOKED SHOTGUN BARREL

(76) Inventor: John Palmer, Calgary (CA)

( * ) Notice: Subject to any disclaimer, the term of this patent is extended or adjusted under 35 U.S.C. 154(b) by 0 days.

(21) Appl. No.: 12/847,044

(22) Filed: Jul. 30, 2010

(51) Int. Cl.
*F41A 21/38* (2006.01)

(52) U.S. Cl. ..... 42/1.06; 89/14.3

(58) Field of Classification Search ..... 42/1.06, 42/76.01, 79; 89/1.703, 14.3, 14.8
See application file for complete search history.

(56) References Cited

U.S. PATENT DOCUMENTS

| | | | | | |
|---|---|---|---|---|---|
| 785,975 | A | | 3/1905 | McClean | |
| 812,140 | A | | 2/1906 | Kent | |
| 1,773,260 | A | * | 8/1930 | Cutts | 42/79 |
| 2,484,998 | A | * | 10/1949 | Hutchinson | 42/79 |
| 2,656,637 | A | * | 10/1953 | Richards | 42/79 |
| 2,668,479 | A | * | 2/1954 | Batten | 89/14.3 |
| 2,791,155 | A | | 5/1957 | Thiel | |
| 2,869,272 | A | * | 1/1959 | Coyle | 42/79 |
| 5,272,827 | A | * | 12/1993 | Vang et al. | 42/79 |
| 5,315,914 | A | * | 5/1994 | Schumacher | 89/14.05 |
| 5,317,825 | A | * | 6/1994 | Vatterott et al. | 42/79 |
| 5,357,842 | A | | 10/1994 | Reynolds | |
| 5,425,298 | A | | 6/1995 | Coburn | |
| 5,587,549 | A | * | 12/1996 | Clouse | 89/14.3 |
| 5,844,162 | A | * | 12/1998 | Renner | 89/14.3 |
| 6,820,530 | B2 | | 11/2004 | Vais | |
| 2002/0117048 | A1 | | 8/2002 | Sevastian | |
| 2003/0024377 | A1 | * | 2/2003 | Diller | 89/14.3 |
| 2003/0084780 | A1 | * | 5/2003 | Rosenthal | 89/14.3 |
| 2003/0106416 | A1 | | 6/2003 | Vais | |
| 2005/0011102 | A1 | * | 1/2005 | Boyer | 42/79 |

* cited by examiner

*Primary Examiner* — Bret Hayes
(74) *Attorney, Agent, or Firm* — Maxey Law Offices, PLLC; Stephen Lewellyn

(57) ABSTRACT

A shotgun barrel of a construction that reduces recoil is provided. The shotgun barrel includes a smooth, non-rifled bore and a choke approximate the muzzle of the barrel. A plurality of vent holes through the barrel and extending into the bore in equal number and in alignment on opposing sides of the barrel along a length of the barrel that is inward of the choke, the sum of the transverse area of each of the plurality of vent holes not exceeding 50% of the muzzle area. A shotgun including the barrel of reduced recoil is also provided.

7 Claims, 3 Drawing Sheets

REDUCED RECOIL CHOKED SHOTGUN BARREL

FIELD OF THE INVENTION

The present invention relates generally to shotgun barrels, and more particularly, relating to a shotgun barrel of a particular design and construction that provides a reduced recoil choked shotgun barrel.

BACKGROUND OF THE INVENTION

When fired, a firearm produces a recoil effect that is caused by the firearm's backward momentum, which exactly balances the forward momentum of the ejecta (the projectile(s), wad, sabot, propellant gas, etc.). In small arms, such as shotguns, the recoil is transferred through the shooter handling the firearm and into the ground. The recoil experienced by the shooter can have damaging effects on the shooter. For example, in shotguns, the shooter can experience a sudden and sharp jolt to the shoulder resulting in bruising of bone and tissue. Numerous devices having a myriad of constructions have been devised to reduce the recoil experienced by a shooter firing a shotgun. While these devises to a lesser or greater extent fulfill their respective objects, there still remains a need for an improved device of simple and low cost construction to reduce the recoil of a shotgun.

SUMMARY OF THE INVENTION

The preferred embodiments of the present invention addresses this need by providing a shotgun barrel of an improved, simple and low cost construction which is able to reduce up to 50% of recoil as compared to a similarly constructed barrel not including the features of the present invention.

The preferred embodiments of the present invention also provide a propellant gas venting shotgun barrel.

The preferred embodiments of the present invention further provide a shotgun barrel having a choke and propellant gas venting.

To achieve these and other advantages, in general, in one aspect, a reduced recoil choked shotgun barrel is provided. The shotgun barrel includes a smooth, non-rifled bore and a choke approximate the muzzle of the barrel. A plurality of vent holes through the barrel and extending into the bore in equal number and in alignment on opposing sides of the barrel along a length of the barrel that is inward of the choke. The sum of the transverse area of each of the plurality of vent holes not exceeding 50% of the muzzle area.

In general, in another aspect, each of the plurality of vent holes are of a diameter not exceeding 0.125 inches. In general, in another aspect, each of the plurality of vent holes are all of the same diameter.

In general, in another aspect, a shotgun is provided. The shotgun includes a first barrel having a smooth, non-rifled bore and a choke approximate the muzzle of the barrel, a plurality of vent holes through the barrel and extending into the bore in equal number and in alignment on opposing sides of the barrel along a length of the barrel that is inward of the choke, the sum of the transverse area of each of the plurality of vent holes not exceeding 50% of the muzzle area.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
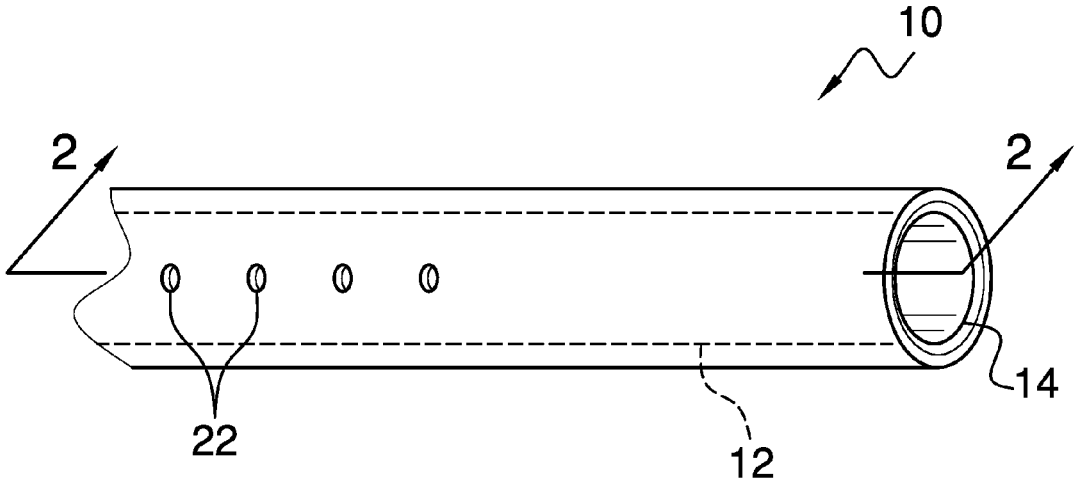
FIG. 1 is a perspective view of a reduced recoil choked shotgun barrel constructed in accordance with the principles of the present invention.
Figure 2:
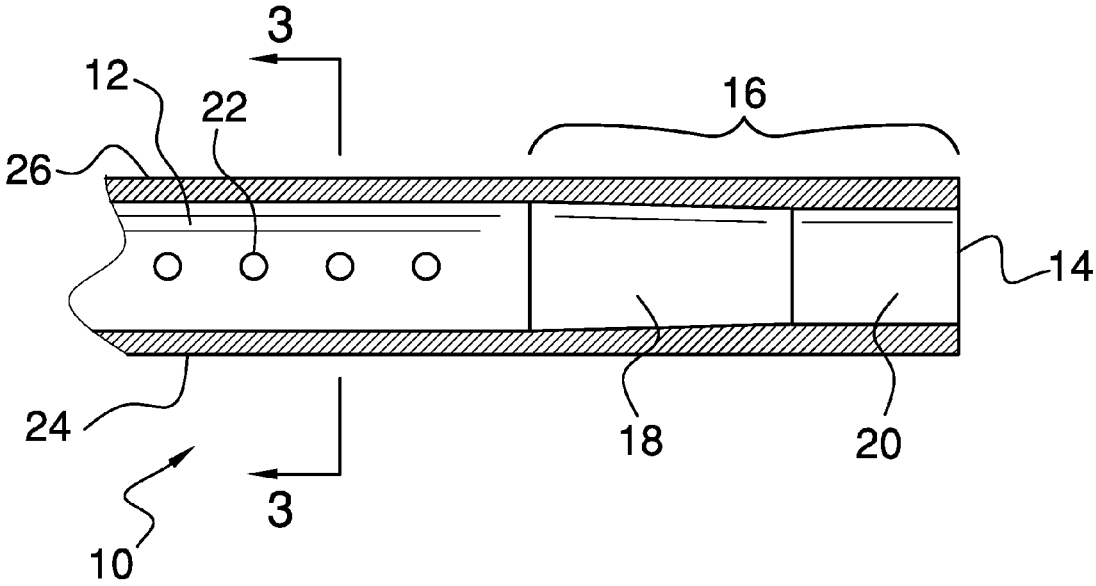
FIG. 2 is a cross-sectional view taken along line 2-2 in FIG. 1 illustrating the construction of the bore and venting holes of the barrel.
Figure 3:
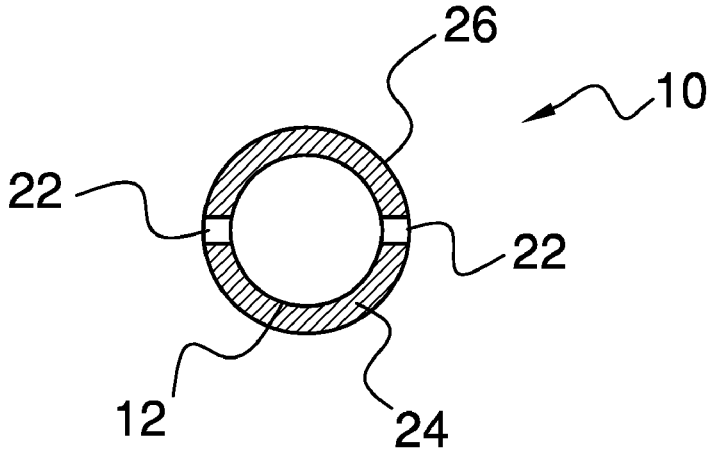
FIG. 3 is a cross-sectional view taken along line 3-3 in FIG. 2.

In FIGS. 1-3 there is depicted an end portion of a shotgun barrel 10 that is specially designed in such a particular manner to reduce recoil of a shotgun utilizing the specially designed shotgun barrel. Barrel 10 comprises a smooth, non-rifled bore 12 terminating at muzzle 14. Bore 12 comprises a choke 16 approximate muzzle 14. The choke 16 consists of a conical section 18 that smoothly tapers from the bore diameter down to the choke diameter, followed by a cylindrical section 20 of the choke diameter.

A plurality of cylindrical-shaped vent holes 22 extend through the sidewall 24 of the barrel 10 from the exterior surface 26 of the barrel and into the bore 12. Vent holes 22 allow a portion of the high pressure propellant gases within the barrel 10 behind the fired ejecta (the projectile(s), wad, sabot, etc.) to escape the barrel 10, and thus reduce recoil. I have discovered that patterning the vent holes 22 in an exact and particular fashion, that is directly related to the area of the muzzle 14, the recoil can be reduced by as much as 50% as compared to a barrel of similar bore and choke not having the exact and particular patterned vent holes.

Specifically, vent holes 22 must extend through the sidewall 24 of the barrel 10 along a length of the barrel that begins approximate the choke 16 and extends inwardly therefrom. An equal number of vent holes 22 must extend on opposite sides of the barrel 10 and must be in coaxial alignment with a corresponding and oppositely located vent hole. In an aspect, the vent holes 22 should be spaced 0.375 inches on center.

Further, the sum of the areas of each vent 22 as measured transversely across and normal to the axis of a vent hole can be equal to, but must not exceed 50% the area of the muzzle 14. In a preferred embodiment, the sum of the areas of each vent hole 22 is exactly equal to 50% of area the muzzle, which I have found reduces the recoil by an equal 50% as compared to a barrel of similar bore and choke. I have discovered a vent hole diameter VD range of 0.094 inches and 0.125 inches on a barrel having a muzzle diameter MD of 0.7 inches provides most efficient recoil reduction. However, of course, the vent hole diameter VD can be scaled in accordance with the muzzle diameter MD. I have further discovered, the sum of the vent hole diameters is directly proportional to the recoil reduction, i.e. a vent hole diameter sum equal to 25% of the muzzle diameter MD will produce a 25% reducing in recoil. In another aspect, the vent holes 22 may be made at a lesser or greater angle to the bore 12 of the barrel 10. However, the openings of oppositely disposed vent holes 22 into the bore 12 must remain coaxial.

Figure 4:
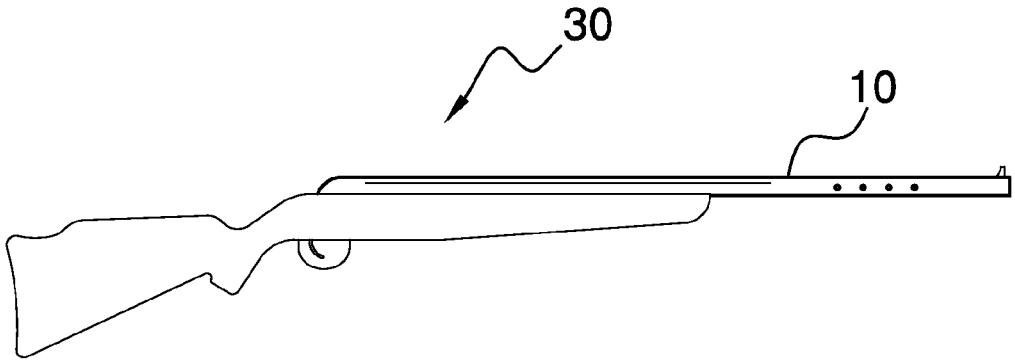
FIG. 4 is a side view of a single barrel shotgun including the shotgun barrel of FIGS. 1-3.

In FIG. 4, there is shown a single barrel shotgun 30 comprising a barrel 10 constructed in accordance with the principles of the invention.

Figure 6:
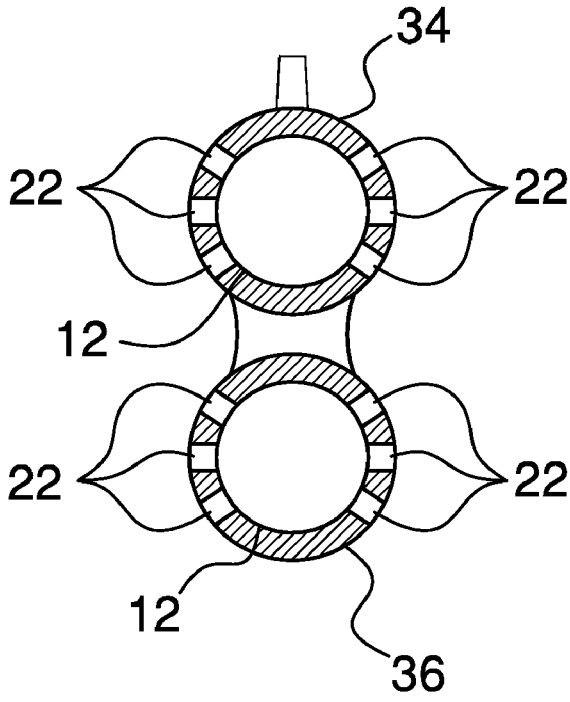
FIG. 6 is a cross-sectional view taken along line 6-6 in FIG. 5.
Figure 5:
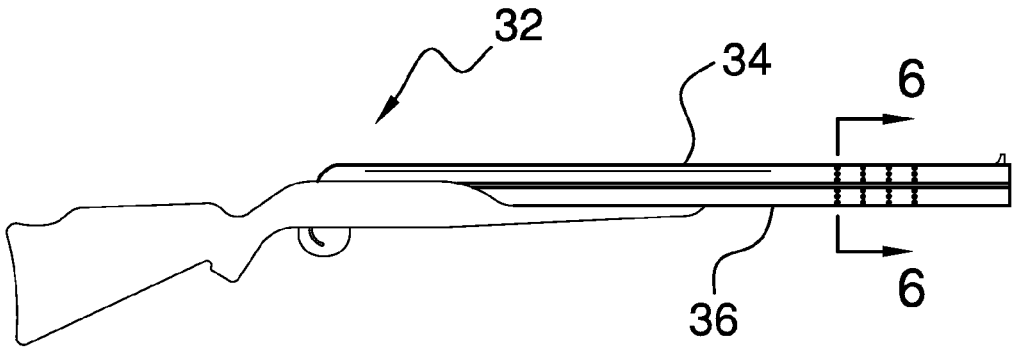
FIG. 5 is a side view of a double barrel, over-under shotgun including the shotgun barrel of FIGS. 1-3.

In FIGS. 5 and 6 there is shown a double barrel shotgun 32 in an over-under barrel configuration comprising a first barrel 34 and a second barrel 36, each constructed as barrel 10 described above and in accordance with the principles of the invention.

A number of embodiments of the present invention have been described. Nevertheless, it will be understood that various modifications may be made without departing from the spirit and scope of the invention. Accordingly, other embodiments are within the scope of the following claims.

What is claimed is:

1. A reduced recoil choked shotgun barrel, comprising:

a smooth, non-rifled bore having an internally bored choke disposed approximately and inwardly of the muzzle of said barrel; and a plurality of vent holes through said barrel and extending into said bore in equal number and in alignment on opposing sides of said barrel along a length of said barrel that is inward of said choke, each of said plurality of vent holes being permanently vented to the atmosphere, and the sum of the transverse area of each of said plurality of vent holes not exceeding 50% of the transverse area of said muzzle.

2. The reduced recoil choked shotgun barrel of claim 1, wherein each of said plurality of vent holes are of a diameter not exceeding 0.125 inches.

3. The reduced recoil choked shotgun barrel of claim 2, where in each of said plurality of vent holes are all of the same diameter.

4. A shotgun, comprising:

a single barrel having a smooth, non-rifled bore having an internally bored choke disposed approximately and inwardly of the muzzle of said barrel, a plurality of vent holes through said barrel and extending into said bore in equal number and in alignment on opposing sides of said barrel along a length of said barrel that is inward of said choke, the sum of the transverse area of each of said plurality of vent holes not exceeding 50% of the transverse area of said muzzle.

5. The shotgun of claim 4, further comprising:

a second barrel having a smooth, non-rifled bore having an internally bored choke disposed approximately and inwardly of the muzzle of said barrel, a plurality of vent holes through said barrel and extending into said bore in equal number and in alignment on opposing sides of said barrel along a length of said barrel that is inward of said choke, the sum of the transverse area of each of said plurality of vent holes not exceeding 50% of the transverse area of said muzzle.

6. A reduced recoil choked shotgun barrel, comprising:

a smooth, non-rifled bore having an internally bored choke disposed approximately and inwardly of the muzzle of said barrel, said muzzle having a muzzle area; and a plurality of vent holes through said barrel and extending into said bore in equal number on opposite sides of said barrel in coaxial alignment with a corresponding and oppositely located vent hole along a length of said barrel that is inward of said choke, the sum of the transverse area of each of said plurality of vent holes not exceeding 50% of the transverse area of said muzzle.

7. The shotgun of claim 6, wherein the sum of the transverse area of each of said plurality of vent holes is equal to 50% of the transverse area of said muzzle.

* * * * *